US008687835B2

(12) United States Patent
Solow

(10) Patent No.: US 8,687,835 B2
(45) Date of Patent: Apr. 1, 2014

(54) DIAPHRAGM FOR AN ELECTROPNEUMATIC HORN SYSTEM

(75) Inventor: Stanley Solow, Plainview, NY (US)

(73) Assignee: Wolo Mfg. Corp., Deer Park, NY (US)

( * ) Notice: Subject to any disclaimer, the term of this patent is extended or adjusted under 35 U.S.C. 154(b) by 0 days.

(21) Appl. No.: 13/297,955

(22) Filed: Nov. 16, 2011

(65) Prior Publication Data

US 2013/0121521 A1 May 16, 2013

(51) Int. Cl.
*G10K 9/04* (2006.01)

(52) U.S. Cl.
CPC ..... *G10K 9/04* (2013.01)
USPC ..... 381/340; 116/142 R; 340/404.1; 340/388.1

(58) Field of Classification Search
CPC ..... G10K 9/04; H04R 2499/13; H04R 1/30; H04R 1/2861
USPC ..... 116/142 R, 137 R, 142 FP, 59; 340/391.1, 388.1, 384.1, 404.1; 280/731; 181/152, 159, 179, 144; 381/340, 86, 386, 389
See application file for complete search history.

(56) References Cited

U.S. PATENT DOCUMENTS

| | | | |
|---|---|---|---|
| D46,917 | S | 2/1915 | Sparks |
| D51,548 | S | 12/1917 | Coulombe |
| D52,941 | S | 2/1919 | Aufiero |
| D53,220 | S | 4/1919 | Genn |
| D55,293 | S | 5/1920 | Marsico |
| D55,294 | S | 5/1920 | Marsico |
| D55,295 | S | 5/1920 | Marsico |
| D70,279 | S | 6/1926 | Jupp |
| D73,217 | S | 8/1927 | Abrahams |
| D73,218 | S | 8/1927 | Abrahams |
| D74,585 | S | 2/1928 | White |
| 1,730,192 | A | 10/1929 | CritchField |
| 1,841,535 | A | 1/1932 | Hueber et al. |
| 1,901,187 | A | 3/1933 | Osborne |
| D99,040 | S | 3/1936 | McBroom |
| D99,177 | S | 4/1936 | Armstrong |
| D100,139 | S | 6/1936 | Weld |
| D108,814 | S | 3/1938 | Aufiero |
| D108,815 | S | 3/1938 | Aufiero |
| D111,187 | S | 9/1938 | Nielsen |
| D111,188 | S | 9/1938 | Nielsen |
| D111,189 | S | 9/1938 | Nielsen |
| D112,883 | S | 1/1939 | MacPhail et al. |
| D112,961 | S | 1/1939 | Nielson |

(Continued)

FOREIGN PATENT DOCUMENTS

WO WO 03/056545 7/2003

OTHER PUBLICATIONS

PCT/US08/71796 filed Jul. 31, 2008, International Search Report and Written Opinion, 9 pages.

*Primary Examiner* — Curtis Kuntz
*Assistant Examiner* — Joshua A Kaufman
(74) *Attorney, Agent, or Firm* — Andrew F. Young, Esq.; Lackenbach Siegel, LLP

(57) ABSTRACT

The invention relates to an improved diaphragm securing mechanism in a sound wave generator system for an electric horn system that includes a monolithic rigid housing member having a receiving opening for fixably housing, in an non-removable and secure manner following assembly, a compressor member, thereby preventing unintended separation and improving a reliability of the electric horn system.

13 Claims, 4 Drawing Sheets

(56) References Cited

U.S. PATENT DOCUMENTS

| | | | | |
|---|---|---|---|---|
| D113,046 | S | 1/1939 | Nielsen | |
| D122,160 | S | 8/1940 | Curtis | |
| D124,796 | S | 1/1941 | Peo | |
| 3,124,098 | A | 3/1964 | Thoben | |
| D206,634 | S | 1/1967 | Guthart | |
| D215,978 | S | 11/1969 | Berns | |
| D222,927 | S | 2/1972 | Tsuhata | |
| 3,846,792 | A | 11/1974 | Haigh | |
| 3,886,546 | A | 5/1975 | Ueda | |
| 4,007,703 | A | 2/1977 | Frigo | |
| D243,834 | S | 3/1977 | Leeder | |
| 4,314,522 | A | 2/1982 | Frigo | |
| 4,763,109 | A * | 8/1988 | Smith | 340/391.1 |
| 4,796,009 | A | 1/1989 | Biersach | |
| D301,989 | S | 7/1989 | Arduini et al. | |
| D312,057 | S | 11/1990 | Pilka | |
| 5,263,435 | A | 11/1993 | Takahashi | |
| 5,964,978 | A | 10/1999 | Hirooka | |
| 6,294,984 | B1 | 9/2001 | Meister | |
| 6,337,003 | B1 | 1/2002 | Kimokiri et al. | |
| 6,337,730 | B1 | 1/2002 | Ozaki et al. | |
| 6,796,265 | B1 | 9/2004 | Dexter et al. | |
| 6,879,370 | B2 | 4/2005 | Yokoue et al. | |
| 7,038,756 | B2 | 5/2006 | Yokoue et al. | |
| 7,712,430 | B2 * | 5/2010 | Solow | 116/142 FP |
| 7,802,535 | B2 * | 9/2010 | Solow | 116/142 FP |
| 2005/0190339 | A1 | 9/2005 | Yokoue et al. | |

* cited by examiner

Fig. 8
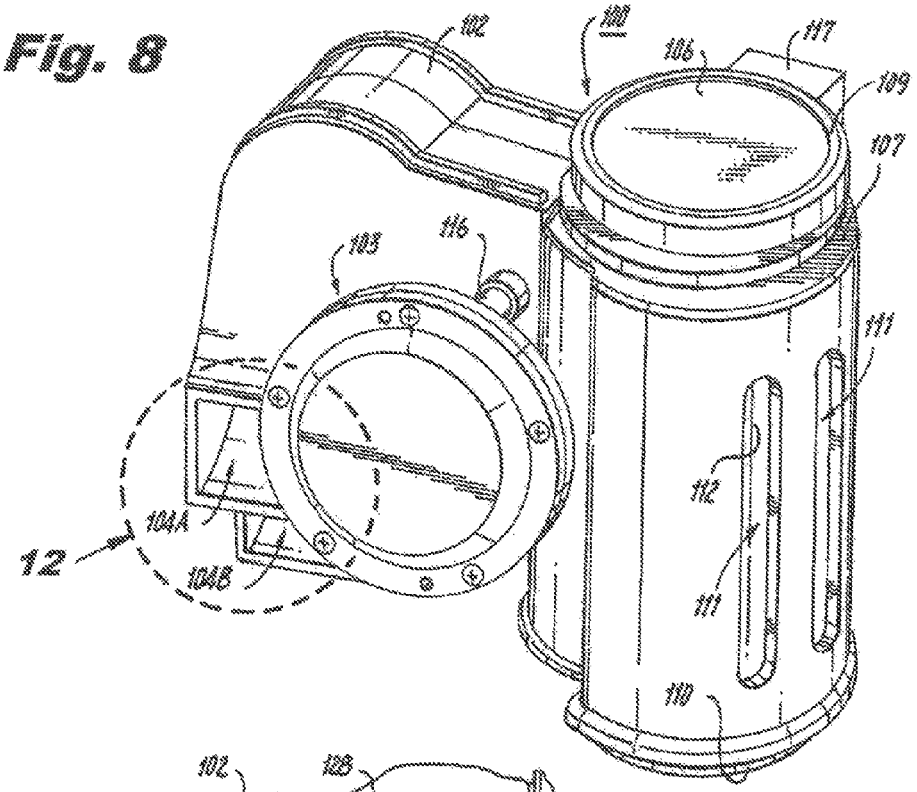
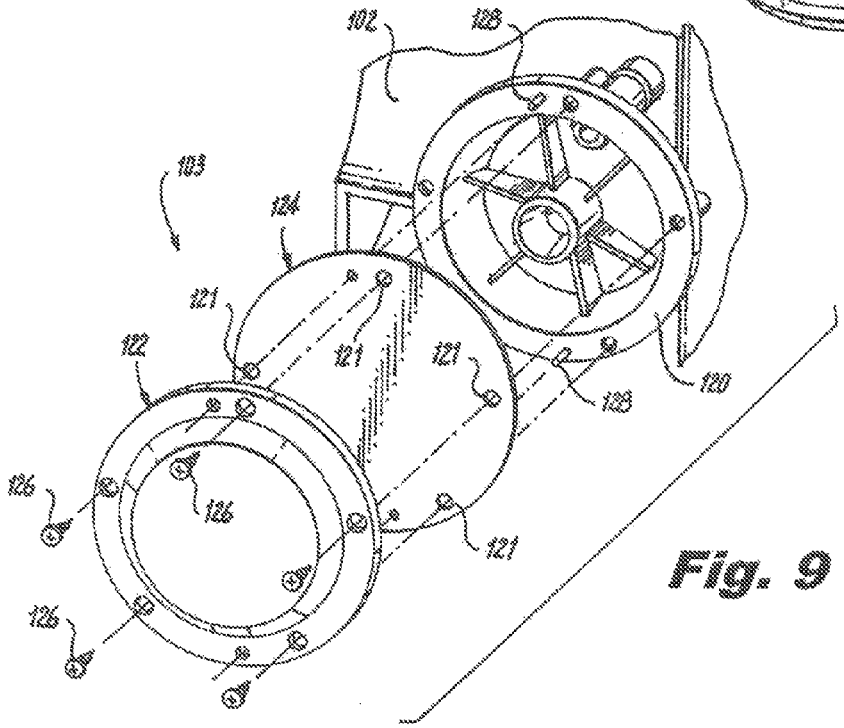
Fig. 9

DIAPHRAGM FOR AN ELECTROPNEUMATIC HORN SYSTEM

CROSS REFERENCE TO RELATED APPLICATIONS

This application claims priority from U.S. Ser. No. 29/402,821 filed Sep. 28, 2011, the entire contents of which are incorporated herein by reference. This application also incorporates herein by reference the entire disclosure of application U.S. Ser. No. 12/183,826, filed Jul. 31, 2008, now U.S. Pat. No. 7,802,535, the entire disclosure of application Ser. No. 12/332,868, filed Dec. 11, 2008, now U.S. Pat. No. 7,712,430, the entire disclosure of application Ser. No. 12/732,367, filed Mar. 26, 2010, now U.S. Pat. No. 7,938,078.

FIGURE SELECTED FOR PUBLICATION

FIG. 9

BACKGROUND OF THE INVENTION

1. Field of the Invention

The present invention relates to an electric horn system. More specifically, the present invention relates to an improved diaphragm system for an electropneumatic horn system.

2. Description of the Related Art

The related art involves generally electric and electropneumatic horn constructions and systems. Electropneumatic horns are those which generate sound by generated air flow or compressed air and are considered (very broadly due to their typical electrical operation of compressed air or air-supply valving) to be within the wider grouping of electric horns due to the electric control of the generation of the air flow or compressed air. It should be noted that electric horn constructions also include (in addition to pneumatic sound creation) the creation of electronic sound (e.g. speaker type systems) wherein sound or tone is the result of an electronic signal to a speaker and not the result of an acoustic passage. As a consequence, those of skill in the art will recognize that the use of the phrases electronic, electrical, and electropneumatic shall be considered non-limiting in the following description.

Conventionally, electropneumatic horns include acoustic units consisting of a straight exponential tube of a length related to the frequency to be reproduced, inserted in an acoustic chamber in which a membrane free to move with a reciprocating motion is arranged and positioned. Also, the straight tube comprises a first stretch with generally constant cross-section, provided with an inlet mouth for the sound signal generated by the oscillating membrane and a second stretch having a section varying with a generally conic exponential law ending with an outlet mouth for the amplified sound signal (e.g., horn shaped).

As used in these conventional electropneumatic horns, the membrane is properly stretched or positioned during a pre-assembly calibration phase by deformation against the membrane of a member referred to as a 'sound generator' and applied to a chamber body, in such a way to generate a sound with manufacturer-desired predetermined acoustic pressure during a use. In an alternatively constructed versions of the related art, the acoustic units are paired (commonly bi-tonal), and the corresponding tubes are volute wound and juxtaposed to limit the overall dimensions of the horn allowing for reduced-size installations.

As already stated said acoustic horns and more particularly those with a straight acoustic tube (e.g., 'truck air horns'), equip motor vehicles and are generally installed in the engine compartments and on vehicle roofs. Acoustic horns with different features are available on the market, both by others and by the present Applicant, and are mainly classified according to the number of acoustic units, generally one to a general maximum of three tuned tonal sounds, each shaped according to the frequency that each unit should reproduce.

The need to optimize space and reduce dimensions of every element of the motor vehicle, has lead to the reduction in size of such electropneumatic acoustic horns generally, and the miniaturization of specific horn components. For example, it is known to reduce the size of the air compressor unit or member as well as reduce the overall size of the acoustic sound units.

Referring now to U.S. Pat. No. 7,712,430, the entire contents of which are herein incorporated by reference, FIG. 1-3 show a conventional electropneumatic horn assembly showing the air venting channels 510. The horn 500 further comprises an electric compressor unit 506 having a compressor air inlet 513 and a compressor air outlet 513 for the supply of compressed air. Additionally, the assembly comprises a monolithic housing assembly 502 having a first housing portion embodying an opening defining a space for reception of the compressor unit 506 in the first housing portion 540, and a second housing portion 545 substantially housing a sound wave generator system. Further, the assembly comprises a plurality of air intakes on the bottom that allow air to be brought along the outer face 512 of the compressor unit 506. The face 512 of the compressor 506, when in use, radiates heat that heats the air moving along the outer face of the compressor 506. The assembly comprises a set of one or more vents 510, embedded in the monolithic housing assembly 502, for venting air from the metal face 512 of the compressor unit 506 for the purpose of reducing air temperature (cooling) across the surface of the compressor assembly 506. This cooling feature prevents burnout of the brushes, and metal fatigue of the compressor components.

The horn assembly comprises: at least one acoustic chamber 504 having an opening for introduction of compressed air; a membrane member provided with an opening for sound generation and at least one acoustic duct housed in the housing assembly and communicating between the at least one acoustic chamber and the at least one horn outlet to propagate sound generated by the membrane member outside the horn. There are also air channeling means for communicating between the compressor air outlet of the compressor unit and the opening of the at least one acoustic chamber. Such a horn assembly comprises means for permanently affixing the electric compressor unit in the housing assembly whereby the affixing means prevent removal of the electric compressor unit and improves operational stability of the housing assembly.

The acoustic chamber according to the prior art is constructed by compressing metal membrane member 506 onto outer housing member 508 by exerting force 514 as shown in FIG. 4. This compressed fit of membrane 506 onto outer housing 508 forms a diaphragm 522 (FIG. 5) for sound generation from the electric horn 500. Outer housing member 508 also includes an inlet opening 516 (FIG. 6) to allow air to enter the chamber formed between membrane 506 and outer housing 508. However, in such a device, unwanted particles such as particle 518 typically enter the chamber through inlet opening 516. Such unwanted particles may become lodged in chamber (see FIG. 6, particle 518A) such that they eventually cause membrane member 506 to deform at points of intersection of the membrane member 506 and outer housing 508

(FIG. 7). Deformities such as this negatively affect the sound emanating from the acoustic chamber.

What is not appreciated by the prior art therefore, is the need for an improved system comprising a diaphragm that is constructed in such a manner so as to substantially prevent the deforming of the membrane member within the acoustic chamber of the electropneumatic horn assembly without minimizing the operational reliability of the horn. Accordingly, there is a need for an improved diaphragm for an electropneumatic horn system, and more specifically an improved electropneumatic horn system that compensates for one or more of the detriments noted above.

SUMMARY OF THE INVENTION

The present invention relates to an improved diaphragm or sound wave generator system for an electric horn system that includes a monolithic rigid housing member having a receiving opening for fixably housing, in an non-removable and secure manner following assembly, a compressor member, thereby preventing unintended separation and improving a reliability of the electric horn system. An acoustic sound wave generator includes an acoustic duct chambering system associated throughout with the monolithic rigid housing member. The acoustic sound wave generator receives compressed air from the compressor member to produce sound and propagate the same externally. A horn mounting system enables ready attachment of the system to a consumer-desired surface; either mechanically, magnetically, adhesively or via any other known attachment or mounting system. The present invention also relates to an electric horn system that allows permanent and irremovable attachment between the monolithic rigid housing member and the compressor member via a series of one-way attachment features preventing unintended separation.

According to the preferred embodiment of the present invention there is provided an electropneumatic acoustic horn assembly, comprising: an electric compressor unit having at least a compressor air inlet and a compressor air outlet for the supply of compressed air, a sound wave generator system substantially housed in a monolithic housing assembly, the sound wave generator system comprising: at least one acoustic chamber having an opening for the introduction of the pressurized air, a membrane member provided with an opening for sound generation and at least one acoustic duct housed in the monolithic housing assembly and communicating between the at least one acoustic chamber and at least one horn outlet to propagate the sound generated by the membrane member outside the horn, air channeling means for communicating between the compressor air outlet of the electric compressor unit and the opening of the at least one acoustic chamber, means for permanently fixing the electric compressor unit in the monolithic housing assembly of the sound wave generator system, whereby the means for irremovably fixing prevents removal of the electric compressor unit and improves operational reliability of the assembly. Importantly, according to the preferred embodiment, the acoustic chamber is comprised of a substantially round and rigid membrane member removably affixed with lateral seal between an outer housing member and an inner housing member attached to the horn assembly. In other words, the membrane member is affixed within the diaphragm without the need to deform the membrane, and thus minimizes or even prevents the potential for deformities caused by unwanted particles entering the sound chamber.

In the preferred embodiment of the diaphragm according to the invention, outer housing, membrane member, and inner housing are all of the same shape and size and are attached via removable attachment means such as screws. Other known attachment means may also be used.

According to another embodiment of the present invention there is provided an electropneumatic acoustic horn assembly, wherein diaphragm includes means for minimizing at least one of a debris and a water entry during a use of the assembly, and the means for minimizing includes at least one selected from a group comprising: an opening seal, at least one flexible louver member, at least one flexible shield member, and at least one of a woven and a metal mesh, whereby the at least one minimizing means enables a release of sound from the horn while minimizing entry of debris and water into the monolithic housing assembly.

According to another embodiment of the present invention there is provided an electropneumatic acoustic horn assembly, comprising: a cylindrical electric compressor unit having at least a compressor air inlet and a compressor air outlet for the supply of compressed air, and a first and opposing second end, a sound wave generator system substantially housed in a monolithic housing assembly, the monolithic housing assembly having a monolithic compressor housing portion having a cylindrical receiving opening, the sound wave generator system comprising: at least one acoustic chamber having an opening for the introduction of the pressurized air, a membrane member provided with an opening for sound generation and at least one acoustic duct housed in the monolithic housing assembly and communicating between the at least one acoustic chamber and at least one horn outlet to propagate the sound generated by the membrane member outside the horn, air channeling means for communicating between the compressor air outlet of the electric compressor unit and the opening of the at least one acoustic chamber, means for permanently fixing the electric compressor unit in the monolithic housing assembly of the sound wave generator system, whereby the means for irremovably fixing prevents removal of the electric compressor unit and improves operational reliability of the assembly.

Another aspect of the present invention is to provide an improved electropneumatic horn system operable at increased weather, environmental, and temperature extremes.

The above and other aspects, features and advantages of the present invention will become apparent from the following description read in conjunction with the accompanying drawings, in which like reference numerals designate the same elements.

BRIEF DESCRIPTION OF THE DRAWINGS

A further understanding of the present invention can be obtained by reference to a preferred embodiment set forth in the illustrations of the accompanying drawings. Although the illustrated preferred embodiment is merely exemplary of methods, structures and compositions for carrying out the present invention, both the organization and method of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the invention.

For a more complete understanding of the present invention, reference is now made to the following drawings in which:

FIG. 8 is a front perspective view of an electropneumatic horn assembly according to the invention showing the improved diaphragm;

FIG. 9 is a exploded perspective view of the diaphragm according to the present invention for use with an electric horn assembly;

DETAILED DESCRIPTION OF THE PREFERRED EMBODIMENTS

Figure 1:
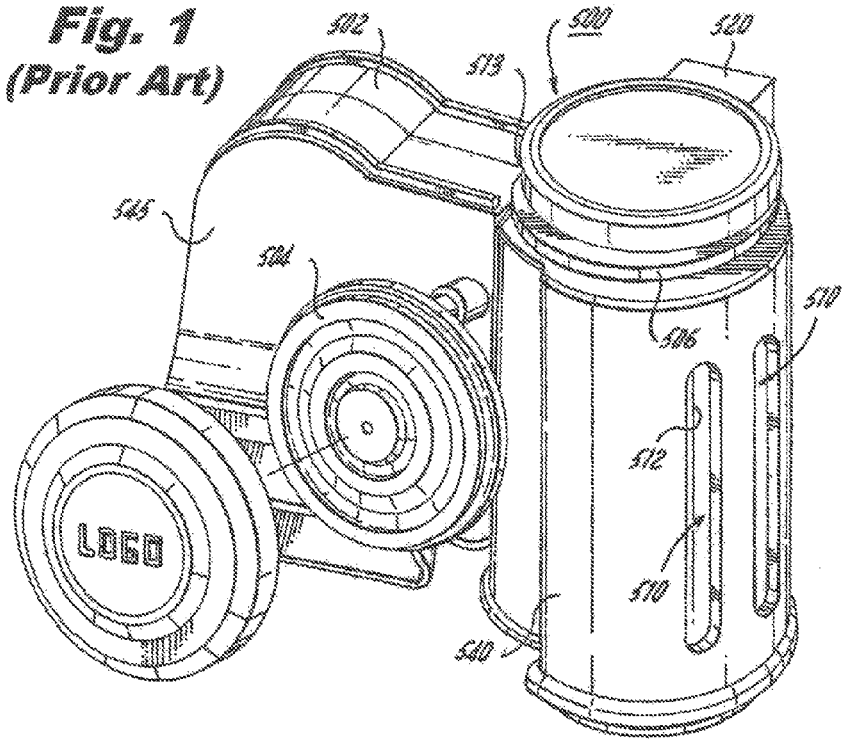
Fig. 1 (Prior Art)
FIG. 1 is a front perspective view of a conventional electropneumatic horn assembly.
Figure 2:
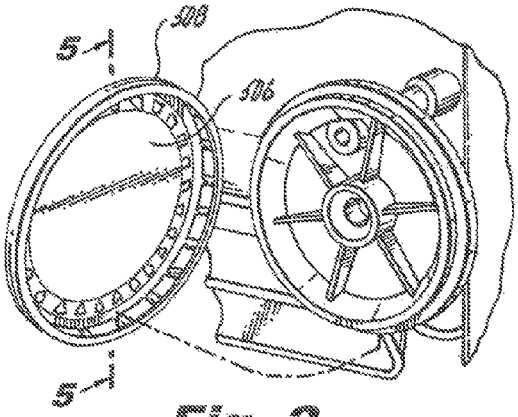
Fig. 2 (Prior Art)
FIG. 2 is an exploded perspective view of conventional diaphragm for an electric horn assembly.
Figure 3:
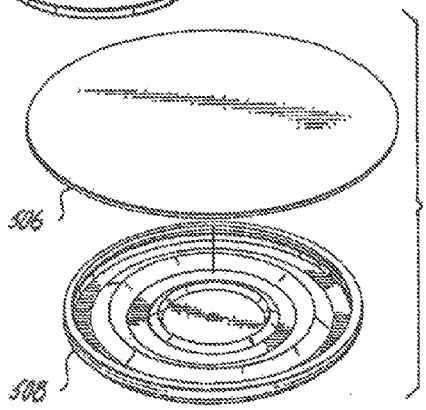
Fig. 3 (Prior Art)
FIG. 3 is an exploded perspective view of the components of a conventional diaphragm for an electric horn assembly.
Figure 4:
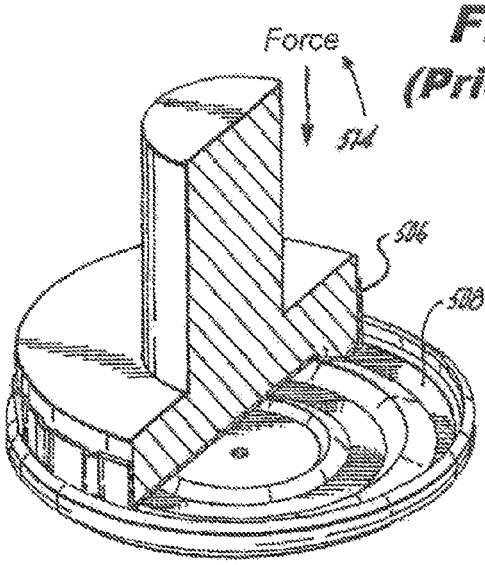
Fig. 4 (Prior Art)
FIG. 4 is perspective view of a prior art diaphragm for an electric horn assembly.
Figure 5:
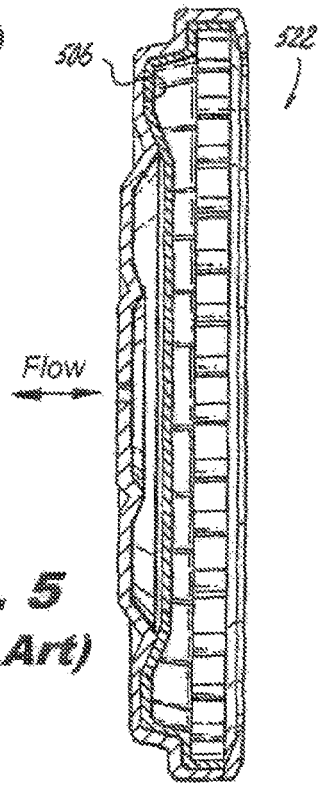
Fig. 5 (Prior Art)
FIG. 5 is side cross-sectional view of a prior art diaphragm for an electric horn assembly.
Figure 6:
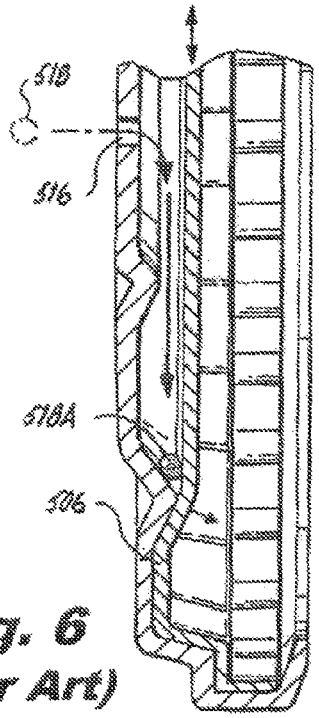
Fig. 6 (Prior Art)
FIG. 6 is a partial side cross-sectional view of the conventional diaphragm shown in FIG. 5, further showing a particle entering the diaphragm.
Figure 7:
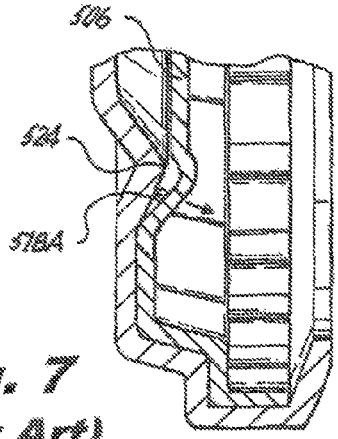
Fig. 7 (Prior Art)
FIG. 7 is a partial side cross-sectional view of the conventional diaphragm shown in FIG. 5, further showing the deformity in the diaphragm caused by the unwanted particle therein.

As required, a detailed illustrative embodiment of the present invention is disclosed herein. However, techniques, systems, compositions and operating structures in accordance with the present invention may be embodied in a wide variety of sizes, shapes, forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention. Applicants hereby incorporate herein again by reference thereto the entire disclosure of their application Ser. No. 12/183,826, filed Jul. 31, 2008, now U.S. Pat. No. 7,802,535, the entire disclosure of their application Ser. No. 12/332,868, filed Dec. 11, 2008, now U.S. Pat. No. 7,712,430, the entire disclosure of their application Ser. No. 12/732,367, filed Mar. 26, 2010, now U.S. Pat. No. 7,938,078.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, below, etc., or motional terms, such as forward, back, sideways, transverse, etc. may be used with respect to the drawings. These and similar directional terms should not be construed to limit the scope of the invention in any manner.

Referring first to FIG. 8, shown is one exemplary embodiment of an electropneumatic horn having a diaphragm according to the preferred embodiment of the present invention that overcomes at least one of the detriments in the related art noted above. In particular, shown is an electropneumatic horn unit 100 which includes a rigid housing unit member 102 having a monolithic compressor housing region 107, and an internally formed dual tonal acoustic ducting system (not shown). The dual tone acoustic ducting system receives compressed air exiting, a compressed air outlet of an air outlet fixture from a compressor unit 106 (as will be discussed), passes the same via diaphragm members 103, 103 (only one shown) through a diaphragm air supply portal 116 so as to activate the same as sound generators. The sound so generated passes through the dual tone ducting system to exist via respective horn openings 104A, 104B. As will be additionally discussed, the tone or sound generation functions of the proposed embodiment are related to those noted in one or more of the incorporated '078, '430, and '535 patents.

As will be noted from study of the renderings, compressor unit 106 having a bottom positioned brush housing member 110 and an opposing top sided compressor member 109 is completely surrounded by the monolithic body structure of housing unit 102 in the manner depicted. Also, a rear suspending bracket 117 may be rearwardly projected from compressor member 109 in a manner familiar to those of skill in the art to secure horn unit 100 to a desired position.

Compressor unit 106 includes an air intake opening proximate compressor member 109, and when compressor unit 106 is operating dispenses compressed air via an air outlet fixture. Upon assembly, the air outlet fixture nests securely within an air outlet receiving block in housing 102 which includes an air intake receiving opening for receiving such generated compressed air for horn operation. The air intake and air outlet fixtures of the proposed embodiment are related to those noted in one or more of the incorporated '078, '430, and '535 patents.

A motor housing spaces brush housing 110 from compressor member 109 and securely engages compressor pump member 109 by, for example, formed bent metal finger members at periodic intervals about a periphery so as to ensure permanent attachment. The motor housing optionally has a metal shell to support the metal finger members but also includes optionally both (a) a plurality of orientation or alignment members protruding at regular intervals about a periphery (three are used herein and two are shown), and (b) permanent locking tab member having a hinged end springingly extending from the motor housing and ending in a cantilevered spring finger portion for engaging and permanently fixing the motor housing into housing unit 102. Optionally, the horn assembly 100 comprises air venting channels 111 to allow venting of the air from the face 112 of the compressor unit within housing unit 102 to reduce the temperature across the surface of the compressor assembly.

During assembly of the present preferred embodiment, it is envisioned that housing unit 102, with monolithic housing member 107 is secured in position and an operator or machine grips a pre-assembled motor housing and a compressor. The operator then orients the compressor so that air outlet fixture is oriented to be fittingly received within the air outlet receiving block and initially engages the bottom of the motor housing in the opening in monolithic housing member 107. While not required for the invention, and as an additional benefit, the motor housing includes a plurality of alignment members that mesh with a plurality of pre-formed alignment slots formed on an inner wall of the compressor opening to aid and secure alignment.

Figure 10:
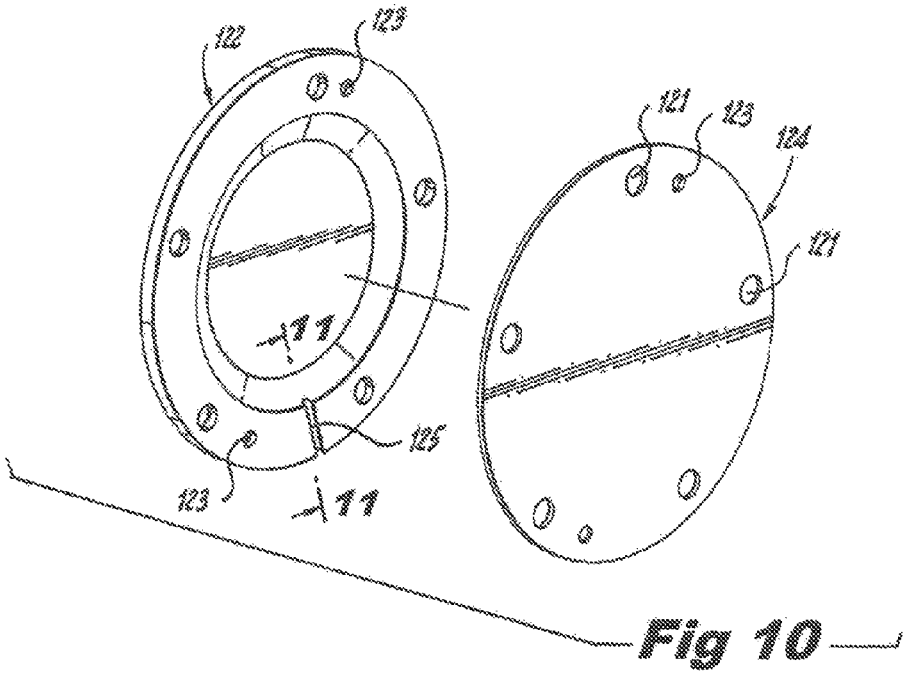
FIG. 10 is a exploded perspective view of the outer components for the diaphragm according to the present invention.
Figure 12:
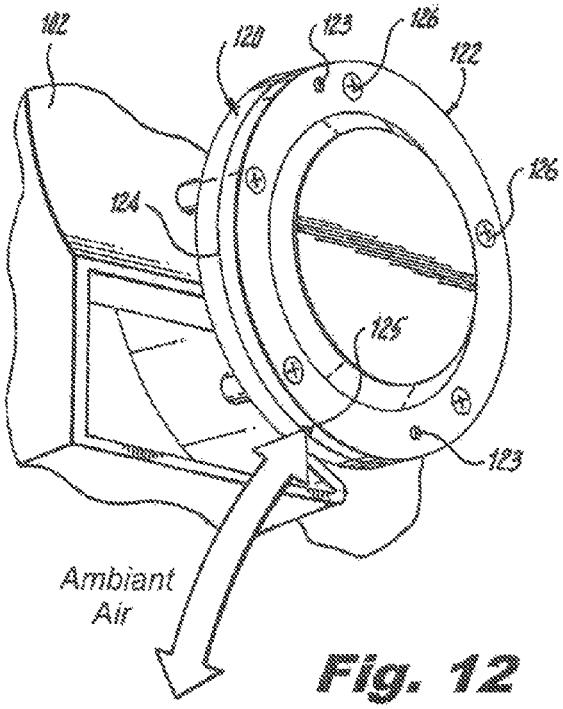
FIG. 12 is a perspective view of the assembled diaphragm for an electric horn assembly according to the present invention.
Figure 11:
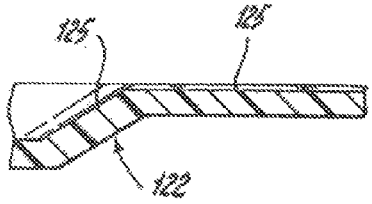
FIG. 11 is a partial cross-sectional view of the diaphragm component shown in FIG. 10 at 11-11 further depicting the air inlet channel that allows ambient air into the acoustic chamber formed in the diaphragm.

Referring next to FIG. 9, shown is an exploded perspective view of diaphragm or sound wave generator 103 according to the preferred embodiment of the present invention. As depicted, diaphragm assembly 103 preferably comprises inner housing member 120, outer housing member 122, and membrane member 124 having a suitable stiffness and thickness for operation. A plurality of attachment openings 121 in membrane member 124 are aligned with corresponding openings in both inner and outer housing members 120/122 such that attachment means such as screws 126, and the like, may be positioned therethrough to secure membrane member 124 securely and with substantially lateral seal between inner housing member 120 and outer housing member 122 to form diaphragm 103. Optionally, or additionally, alignment pins 128 may be provided on inner housing member 120 to aid in aligning each of said inner housing member 120, said outer housing member 122, and said membrane member 124 via openings 123 (see FIGS. 10-12), in this embodiment, screws 126 enable an operator to easily access the interior of diaphragm 103 for quick and efficient cleaning and/or replacement of parts as necessary. While screws 128 are shown, it will be appreciated by one of ordinary skill in the art that other removable attachment mechanisms may be utilized of any kind without limitation, including clamps, lugnuts, wingnuts, bolts, and the like as will be understood from study of the enclosure. As shown in FIGS. 10-12, outer housing member 122 preferably comprises air inlet channel 125 to allow ambient air to enter and leave the acoustic chamber formed when inner housing member 120 and outer housing member 122 are removably affixed together by screws 126.

As will be noted from the disclosure, air inlet channel 125 is a small molded recession in the outer rim of housing member 122 (See FIGS. 10 and 11), but will be understood as non-limiting. Thus, for example, air inlet channel is a long-access pathway of narrow size that would readily permit ambient air pressure to be maintained (to permit suitable horn operation) but will prevent all physical matters from entry, and certainly from successfully passing the entire length. Similarly, air inlet channel 125 is orientated downwardly in the gravity field so that rain and water used in washing will not enter the same. Similarly, it will be noted that the air inlet channel may be divided into two or more small 'micro-channels' so that one or more may be clogged while ambient air pressure will continue to be retained across diaphragm member 124 while preventing damage thereto. Further, air inlet channel may be formed at an angle (not radially as shown) or in a circuitous rout (e.g., curved, in a U-shape, etc.) relative to the outer surface of member 122.

During use, it will be understood that the following method of use may be adaptively modified to retain continuous operation of the device. Should there be damage to member 124, or should dirt or debris of any kind enter either side of the chamber formed by 120, 122, then the user will remove the screws (means of any kind) 126, will wash physically the debris away and otherwise clean the components, and will manually reassemble with a suitable alignment. Necessarily, the outer edge of member 124 need not reach the full extent shown for suitable operation, and may be less than or more than the full outer shape of member 122 as long as sufficient tension is maintained thereacross following reassembly and reattachment.

In the claims, means or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that such embodiments are merely exemplary and that the invention is not limited to those precise embodiments, and that various changes, modifications, and adaptations may be effected therein by one skilled in the art without departing from the scope or spirit of the invention as defined in the appended claims. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. An electropneumatic horn assembly, said horn assembly comprising:

an electric compressor unit having at least a compressor air inlet and a compressor air outlet for the supply of compressed air;

a monolithic housing assembly having a first housing portion embodying an opening defining a space for reception of said compressor unit in said first housing portion, said housing assembly having a second housing portion;

a sound wave generator system including:

at least one acoustic chamber formed between an inner acoustic housing and an outer acoustic housing, said acoustic chamber having an opening for introduction of compressed air, a substantially planar membrane member uninterrupted by a vent opening and rigidly removably secured between said inner acoustic housing and said outer acoustic housing, said outer acoustic housing provided with an air inlet channel oriented downwardly for allowing entry of ambient air into said acoustic chamber, said chamber further having at least one acoustic duct housed in said housing assembly and communicating between said at least one acoustic chamber and at least one horn outlet to propagate sound generated by said membrane member outside said horn; and air channeling means for communicating between said compressor air outlet of said compressor unit and said opening of said at least one acoustic chamber.

2. The horn assembly of claim 1, wherein said electric compressor unit is of a cylindrical external configuration, said first housing portion reception space being of cylindrical configuration companion to that of said electric compressor unit.

3. The horn assembly of claim 1, wherein said inner housing and said outer housing comprise attachment means for removably attaching said inner housing with said outer housing.

4. The horn assembly of claim 3, wherein said membrane member is positioned with lateral seal between said inner housing and said outer housing.

5. The horn assembly of claim 3, wherein said attachment means is selected from the group consisting of screws, clamps, lugnuts, wingnuts, and bolts.

6. The horn assembly of claim 3, wherein said attachment means further comprises alignment pins for aligning said inner housing, said membrane member and said outer housing.

7. The horn assembly of claim 1, wherein said air compressor unit embodies an air compressor pump at a top end thereof, said air compressor unit having a bottom end opening, and means for sealing said bottom end to minimize an entry of debris and water into said monolithic housing assembly through said air compressor bottom end.

8. A sound wave generator system for an electropneumatic acoustic horn assembly, said sound wave generator system comprising:

an acoustic chamber formed between an inner acoustic housing and an outer acoustic housing, said acoustic chamber having an opening for the introduction of pressurized air, a substantially planar membrane member uninterrupted by a vent opening and removably positioned between said inner acoustic housing and said outer acoustic housing, said outer acoustic housing provided with an air inlet channel oriented downwardly for allowing entry of ambient air into said acoustic chamber, said chamber further having at least one acoustic duct communicating between said at least one acoustic chamber and at least one horn outlet; and air channeling means for communicating between said opening of said acoustic chamber and an air outlet of an electric compressor unit for said electropneumatic horn assembly.

9. The sound wave generator system of claim 8, wherein said membrane member is provided with an opening for sound generation and at least one acoustic duct housed in a housing assembly and communicating between said acoustic chamber and at least one horn outlet to propagate sound generated by said membrane member outside said horn.

10. The sound wave generator system of claim 8, wherein said inner housing member and said outer housing member comprise attachment means for removably attaching said inner housing with said outer housing.

11. The sound wave generator system of claim 10, wherein said membrane member is positioned with lateral seal between said inner housing member and said outer housing member.

12. The sound wave generator system of claim 10, wherein said attachment means is selected from the group consisting of screws, clamps, lugnuts, wingnuts, and bolts.

13. The sound wave generator system of claim 10, wherein said attachment means further comprises alignment pins for aligning said inner housing, said membrane member and said outer housing.

* * * * *